US007191494B2

(12) United States Patent
Badiali

(10) Patent No.: US 7,191,494 B2
(45) Date of Patent: Mar. 20, 2007

(54) STABILIZER FOR ROTARY TOOLS

(76) Inventor: John A. Badiali, 1060 Endeavor Ct., S-A, Nokomis, FL (US) 34275

( * ) Notice: Subject to any disclaimer, the term of this patent is extended or adjusted under 35 U.S.C. 154(b) by 0 days.

(21) Appl. No.: 10/914,926

(22) Filed: Aug. 9, 2004

(65) Prior Publication Data

US 2005/0034276 A1 Feb. 17, 2005

Related U.S. Application Data

(60) Provisional application No. 60/494,187, filed on Aug. 11, 2003.

(51) Int. Cl.
*B25G 1/00* (2006.01)

(52) U.S. Cl. ..... 16/426; 16/436; 16/429; 16/900

(58) Field of Classification Search ..... 16/426, 16/408, 429, 436, 436 X, 900 X; 81/177.2, 81/177.5–177.9; 294/58; 408/124, 241 R; 74/523, 525, 543, 551.9
See application file for complete search history.

(56) References Cited

U.S. PATENT DOCUMENTS 2,545,659 A * 3/1951 Ginter ..... 16/426
3,892,458 A * 7/1975 Clark ..... 439/319
4,155,278 A 5/1979 Estok ..... 81/57.11
4,462,282 A 7/1984 Biek ..... 81/57.11
4,840,082 A * 6/1989 Terashima et al. ..... 74/523
6,125,721 A 10/2000 Yang ..... 81/57.29
6,202,504 B1 * 3/2001 Burkle ..... 74/544
6,241,594 B1 * 6/2001 Lepold ..... 451/359
6,386,075 B1 * 5/2002 Shiao ..... 81/177.8
6,499,172 B1 12/2002 McCracken ..... 15/97.1
6,520,053 B2 * 2/2003 Liao ..... 81/177.9

* cited by examiner

*Primary Examiner*—Chuck Y. Mah
(74) *Attorney, Agent, or Firm*—Gifford, Krass, Sprinkle, Anderson & Citkowski, P.C.

(57) ABSTRACT

The stabilizer apparatus for a power head attachment for rotationally powered tools in which a housing supports a stabilizer apparatus including a stabilizer collar rotatable to selected positions relative to the input shaft of the head attachment and a stabilizer arm pivotally mounted on the collar for movement to selected angular positions relative to the axis of the input shaft between a plurality of locked positions and a single unlocked position. In the unlocked position of the arm, the collar can be rotated to various circumferential positions and in each one of the positions the stabilizer arm can be located at a selected one of multiple angular positions which also lock the arm and collar in a fixed position making possible many combinations of positions of the stabilizer arm relative to the power head of the tool.

13 Claims, 3 Drawing Sheets

STABILIZER FOR ROTARY TOOLS

REFERENCE TO RELATED APPLICATION

This application claims priority of U.S. Provisional Patent Application Ser. No. 60/494,187, filed Aug. 11, 2003, the entire content of which is incorporated herein by reference.

FIELD OF THE INVENTION

This invention relates to drive attachments for rotary tools and more particularly to stabilizing arms or torque absorbing arms for such tools and attachments.

BACKGROUND OF THE INVENTION

Attachments to rotary tools such as cordless rotary drills or screwdrivers require careful positioning to maintain alignment between the work to be performed and the rotating output tool. Also, the work to be performed may be located in an awkward location and require the special positioning of the tool and its stabilizing means.

Prior devices have had torque-absorbing arms which can be detachably attached to the tool at a ninety-degree (90°) angle to the axis of rotation. In some cases such attachment is to a single location and in still others to a number of selected positions annularly or circumferentially of the axis of rotation. Almost all of such devices require the threading and un-threading of a handle into a selected opening. None of such devices permit the angular adjustment of the handle relative to the axis of rotation and also the circumferential or annular adjustment to selected positions around the axis of rotation.

SUMMARY OF THE INVENTION

The present invention makes adjustment possible of both the angle of the handle and its annular position relative to the tool or its attachments with a single control without the need to remove any parts from the tool.

It is an object of the invention to provide a stabilizer arrangement for an attachment for power tools in which the arm can be adjusted at various angles in any one of multiple positions selected circumferentially of the axis of the drive of the tool.

It is a further object of the invention to provide a stabilizer arrangement for a power head for a tool in which multiple positions of the stabilizer arm are achieved with a single control in the form of the stabilizer arm.

The objects of the invention are obtained by an accessory for power tools in which a housing supporting an input shaft and an output shaft are connected together with the input shaft being adapted for detachable attachment to a power tool and the output shaft being adapted for a detachable attachment to a working tool such as a screw driver or a nut driver. The housing supports a stabilizer assembly having an annular collar supported on the exterior of the housing for movement annularly in a first plane to selected indexed positions relative to the axis of the input shaft and a stabilizer arm supported on the collar for movement together of the collar to selected angular positions in a second plane perpendicular to the first plane and relative to the axis of the input shaft and lock means operable between a selected lock position holding the collar and arm stationary relative to said housing and an unlocked position permitting movement of the collar and arm as a unit to selected annular positions relative to housing. The stabilizer arm is lockable in a selected one of the angular lock positions at each of the selected positions of the stabilizer collar.

DETAILED DESCRIPTION

Figure 6:
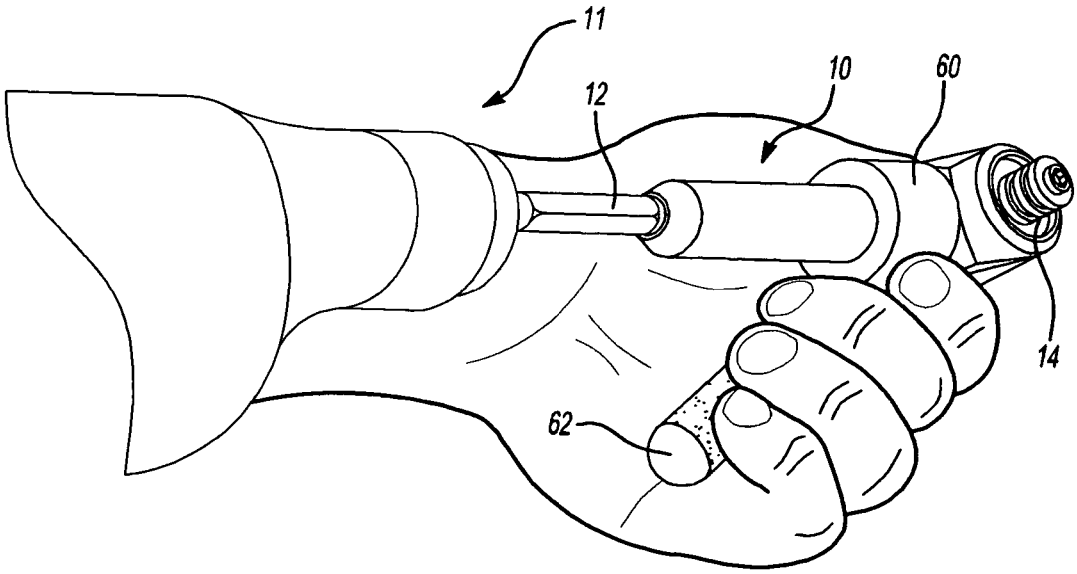
FIG. 6 is a view showing the attachment and rotary tool positioned relative to the left hand of an operator.

The drive head of the invention is designated generally at 10 and is adapted for attachment to powered rotary tools such as drills or screwdrivers a portion of one being indicated at 11 in FIG. 6 in which one hand of an operator can align and steady the drive head 10 and the other hand holds and triggers the drill 11. The head 10 is connected to such drills or drivers by way an input shaft 12 and is suitable for driving quick release drills or fastener drivers by way of a quick release output chuck 14.

Figure 1:
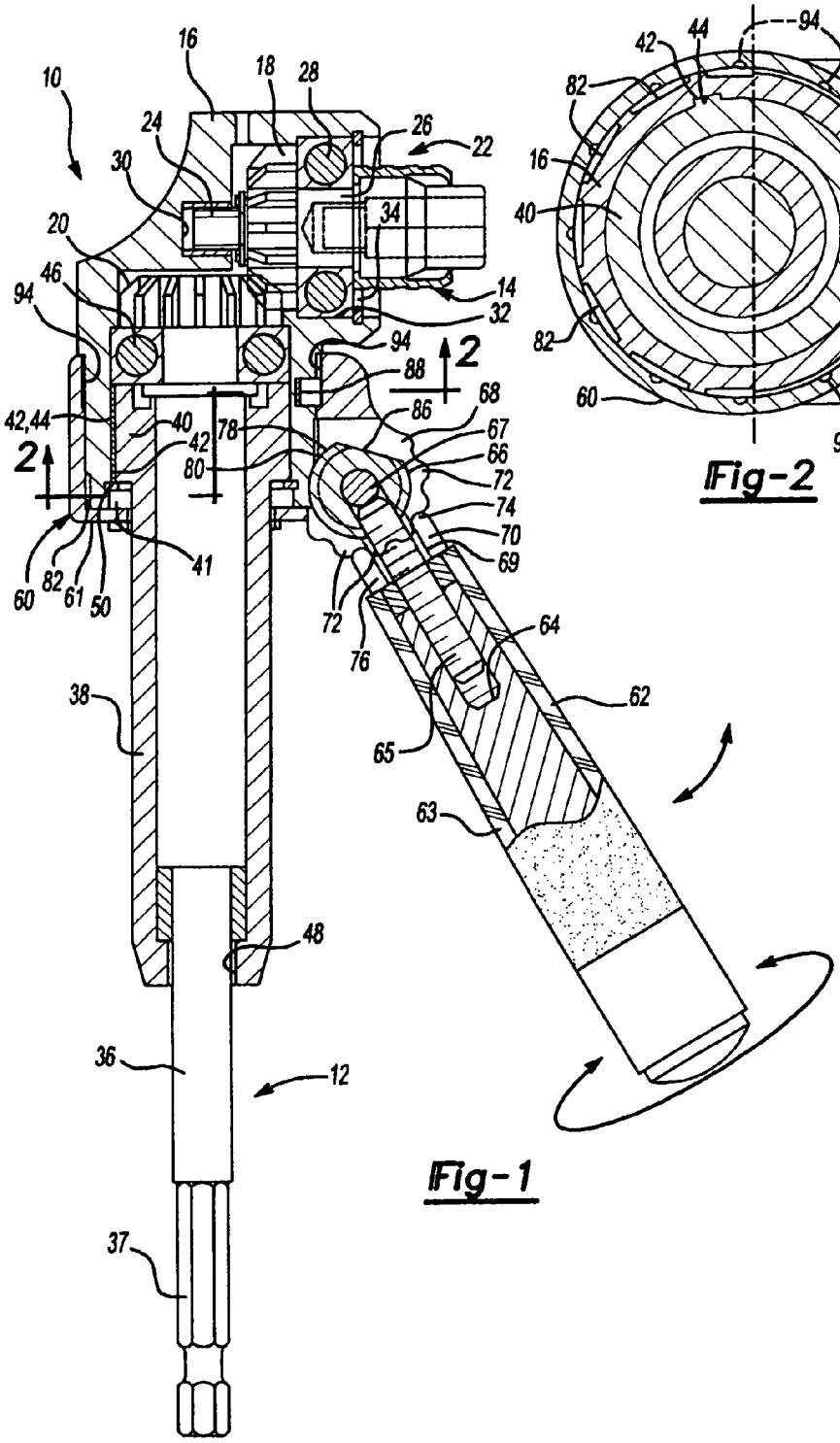
FIG. 1 is a longitudinal cross-section rotary tool attachment including a stabilizer embodying the invention.

The drive head 10 includes a housing 16 which serves to support miter gears 18 and 20 as seen in FIG. 1 which change direction of drive from the tool motor a full ninety degrees (90°) from the input shaft 12 to the axis of output chuck 14.

Miter gear 18 forms part of an output assembly 22 which includes chuck 14 and a stub shaft 24 extending from one face of miter gear 18. The opposite face of miter gear 18 has a shaft extension 26 journaled in a ball bearing unit 28 and supports the quick release chuck 14 which typically would support a one-quarter inch (¼") accessory or working tool such as a hex drill bit or hex screw or nut driver. The output assembly 22 is supported in housing 16 with stub shaft 24 rotatably seated in a complementary blind bore 30 formed in an interior wall of the housing 16 and with the outer face of bearing 28 pressed into a complementary annular recess 32. The entire output assembly 22 is held within and relative to the housing 16 by a snap ring 34 seated in an internal annular groove in the output opening of the housing 16.

The other miter gear or input gear 20 is identical to the output miter gear 18 and is fixed to one end of the drive shaft 12. The other end of the drive shaft is provided with a stepped chuck receiving stem portion 36 for receiving a conventional three-eighths (⅜) collet chuck or a smaller diameter portion 37 for receiving a one-quarter inch (¼") bit chuck commonly found on powered drills and screwdrivers.

The miter gear 20 and the drive shaft 12 is supported within the housing 16 by a shaft sleeve 38 which forms an extension of the housing 16. The sleeve 38 has an enlarged head portion 40 that fits within an input opening 41 to the housing 16. The enlarged head portion 40 is provided with an axially extending key portion 42 which is seated in a slot 44 formed in the housing 16 to prevent rotational movement of the sleeve 38 relative to the remainder of the housing 16. The drive shaft 12 is provided with a ball bearing assembly 46 adjacent to miter gear 20 which is seated within the housing and is held axially in position by the head portion 40 of sleeve 38. An intermediate portion of the drive shaft 12 is received in an opening 48 in the end of sleeve 38 opposite to the head 40. The entire input drive assembly which is made up of the drive shaft 12, miter gear 20, ball bearing 46 and sleeve 38 is held in position relative to housing 16 by a snap ring 50 seated in an internal annular groove in the input opening 41 to housing 16.

The stabilizer system for the driver head 10 includes a stabilizer collar 60 which is rotatably supported on the exterior of the housing 16 for a three hundred sixty degree (360°) rotation movement to selected indexed positions relative to the input axis of the drive shaft 12 and a stabilizer arm 62 mounted on the collar 60, so that it can be moved to selected angular positions relative to the axis of the input shaft 12 of the drive head 10. The stabilizer collar 60 is generally tubular and has an annular wall 61 at one end that acts to cover the input opening 41 of the housing 16.

Figure 3:
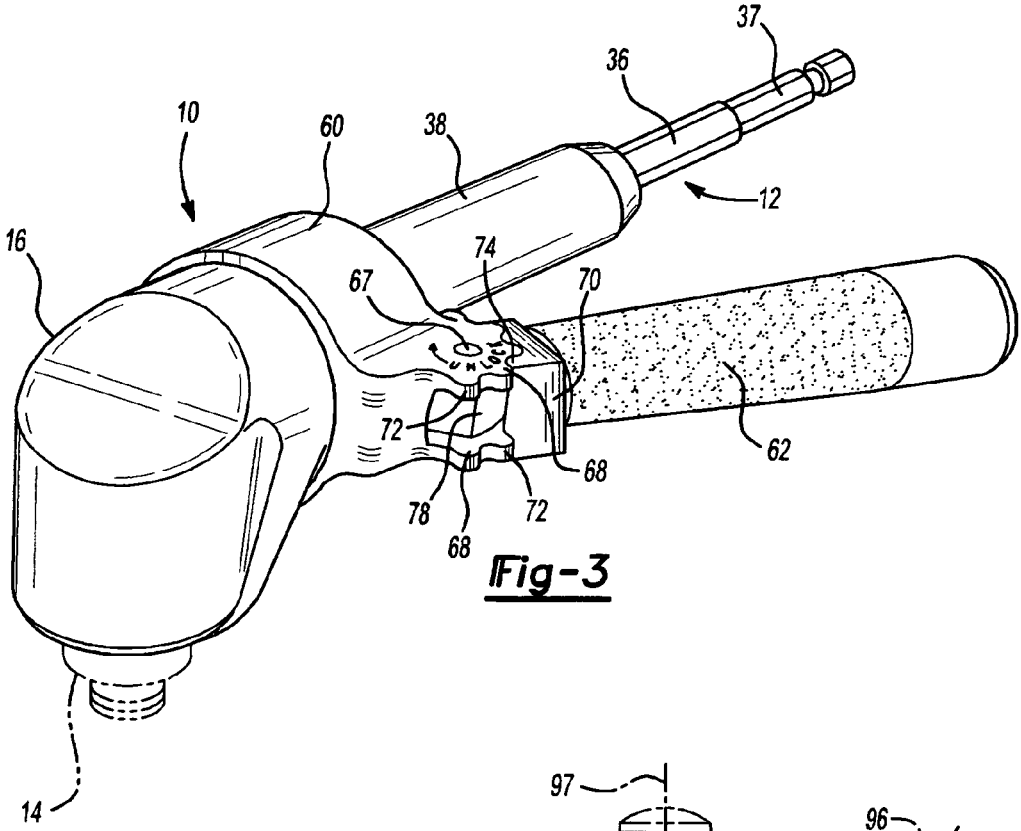
FIG. 3 is a perspective view of the tool attachment showing one position of adjustment.

The stabilizer arm 62 has a covered handle portion 63 with a threaded blind bore 64 at one end to receive the complementary threads on a stud 65 extending radially from a head portion 66. The head portion 66 is mounted on the intermediate portion of a pivot pin 67. The pivot pin 67 is supported with its axis extending tangentially on the tubular collar 60 by a pair of spaced bracket members 68 as seen in FIG. 3 receiving opposite ends of the pivot pin 67.

The head portion 66 also has a rectilinear support base 69 at the inner end of the stud for supporting a pawl washer or pawl element 70. The base member 69 extends radially from the head portion 66 to receive the pawl washer 70 having a complementary rectilinear opening to receive the rectilinear base portion 69. This prevents rotation of the pawl washer 70 about the axis of stud 65 but permits axial movement.

The brackets 68 supporting the opposite ends of the pivot pin 67 are arcuate in shape and each is provided with rounded teeth 72 that are transversely aligned with each other and are adapted to engage complementary rounded teeth 74 formed on the pawl element or washer 70.

The pawl washer 70 is normally held in position on the threaded stud 65 in a clamped position between the arm 62 and the pair of bracket members 68. In that position the stabilizer arm 62 is clamped in the fixed position relative to the collar 60. To change the position of the stabilizer arm 62 it is unthreaded a slight amount on the stud 65 to unclamp the pawl element 70. The arm 62 can then be pivoted or indexed to selected positions. To lock the arm 62 in a fixed position, the arm 62 is rotated on the threaded stud 65 so that the complementary teeth 74 on the pawl and teeth 72 on brackets 68 are gradually brought into engagement with each other and gradually into alignment or mesh with each other because of the rounded teeth. This feature obviates the need for a detent mechanism to assure alignment of the teeth upon tightening of the handle 63.

The head portion 66 of the stabilizer arm 62 also forms a locking cam 78 by which the stabilizer collar 60 can be fixed in selected positions circumferentially or annularly of the input axis of the drive shaft 10. As seen in FIG. 1, cam portion 78 protrudes through an opening 80 in the wall of the collar 60 formed between the pair brackets 68. Locking cam is shaped to engage with lock notches or recesses 82 formed on the outside of housing 60 and uniformly spaced circumferentially adjacent to the opening 48.

Figure 4:
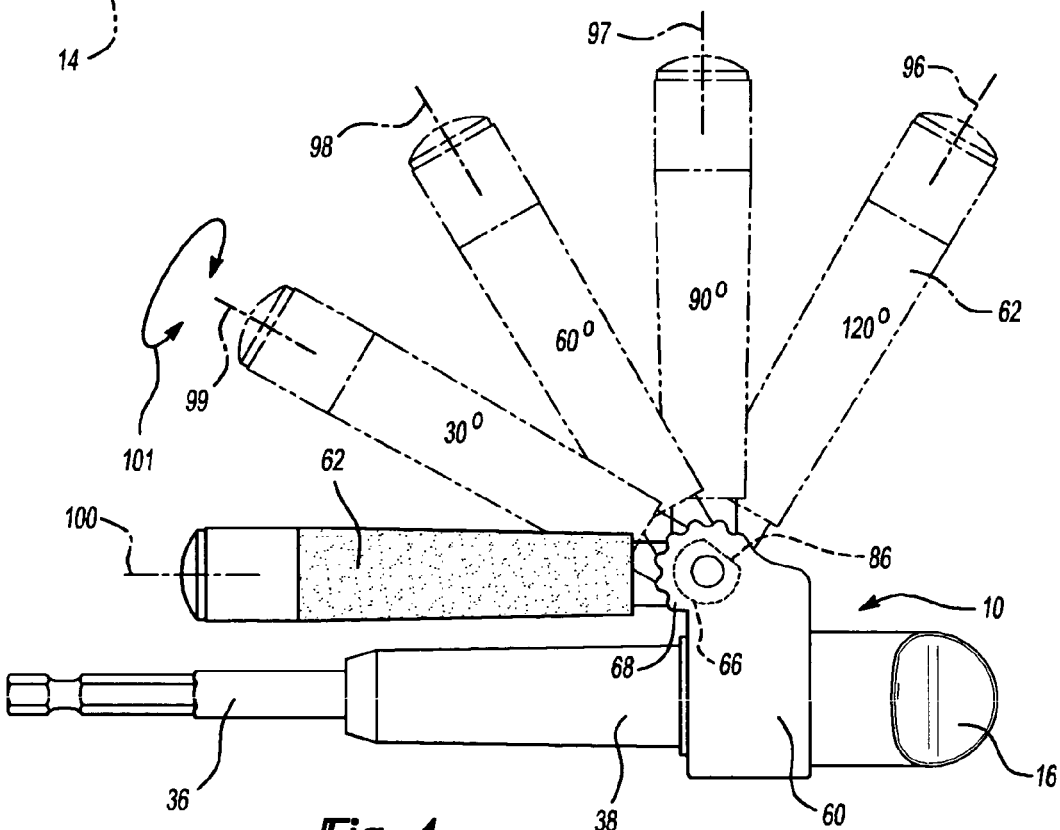
FIG. 4 is a generally diagrammatic view of a top view of the attachment showing various positions of angular adjustment of the stabilizer arm.

The cam head 66 also is provided with a flat portion 86 seen in FIGS. 1 and 4. When the flat portion 86 is in alignment with the opening 80 in the collar 60, the collar can be rotated relative to the housing 16. However, when portions of the cam 78 protrude through the opening 80, the cam portions 78 are disposed in one of the lock recesses 82 in the housing 16 to prevent movement of the collar 60 which is fixed in the selected position.

Figure 5:
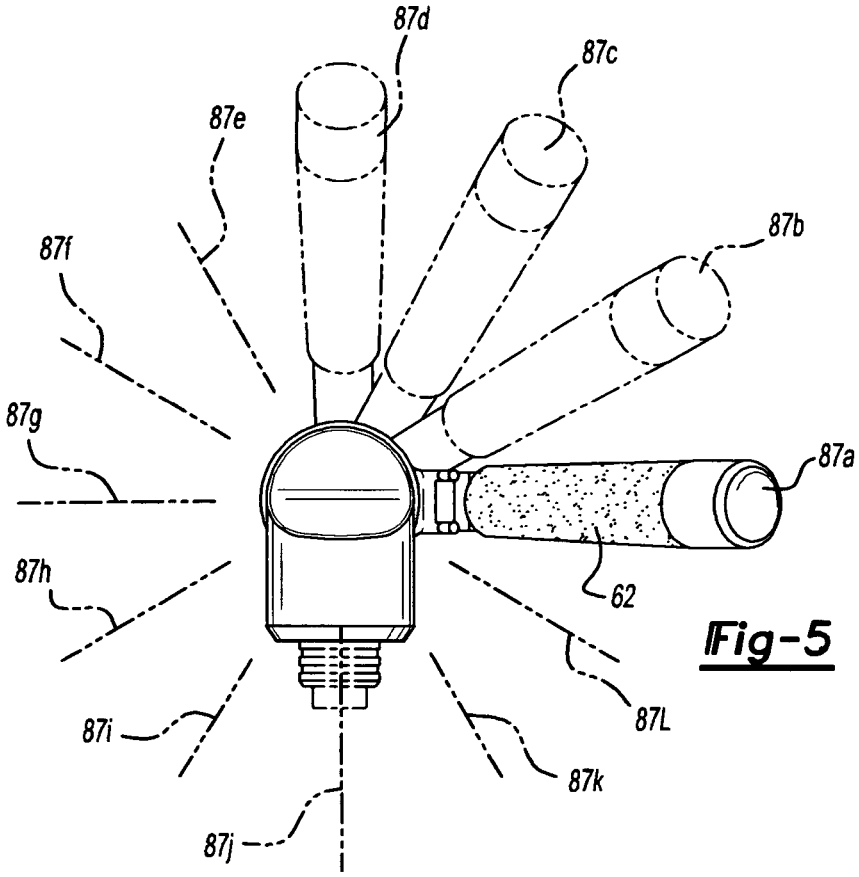
FIG. 5 is an end view showing various annular positions of the stabilizer arm relative to the longitudinal axis of the input shaft.

When the arm 62 is used to pivot the head 66 to a position where the flat surface 86 is in alignment with the opening 80 as would occur at position 96 of the arm 62 in FIG. 4, the collar 60 may be rotated or indexed to a selected one of twelve positions as illustrated in FIG. 5 at 87*a* through 87*l*.

Figure 2:
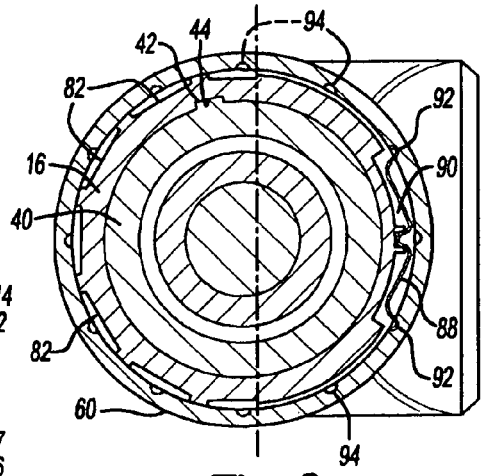
FIG. 2 is a cross-sectional view taken generally on line 2—2 in FIG. 1 at an enlarged scale.

The selected annular positions of the collar 60 relative to the housing 16 are determined by a detent arrangement in which a leaf spring 88 (FIG. 2) is seated in a cavity 90 formed on the exterior surface of the input side of the housing 16. The leaf spring 88 is held against rotation in the cavity 90 and its opposite ends form detent elements 92 adapted to engage the notches in detent recesses 94 that are formed on the inside surface of the stabilizer collar 60. In the preferred embodiment of the invention the detent recesses 94 are twelve in number and are uniformly spaced so that when collar 60 is rotated relative to the housing 16 the collar is indexed to one of twelve positions or every thirty degrees (30°). In like manner, lock slots 82 in the outer circumferential surface of the housing 16 at the input end are also twelve in number and spaced every thirty degrees (30°) of the circumference. The detent spring 88 and it's complementary detent recesses 94 are in alignment with lock recesses or notches 82 in the housing 16 so that rotation of the stabilizer collar 60 to any of its twelve positions relative to the housing 16 will also place the corresponding lock slots 82 in alignment with the opening 80. Subsequent pivoting of handle 12 from its unlocked position at 96 in FIG. 4 will bring the lock cam or surface 78 into alignment and engagement with the corresponding slot 82 in the housing 16 to prevent rotation of the collar 60 from that selected annular position. Subsequent turning of the arm 62 while holding it in the selected angular position locks the collar 60 and arm 62 and places the power head 10 in condition for use.

It will now be seen that the stabilizer collar 60 can be indexed or adjusted to twelve radial positions around the input axis. In addition the arm or handle 62 can be adjusted to any one of five positions which includes the unlocked position indicated by dash line at 96 and four locked positions indicated at 97, 98, 99 and 100. In the first or unlocked position at line 96 the flat surface 86 on head portion 66 on pawl washer 70 will be in alignment with the opening 80 and no part of the arcuate cam or lock portion 78 will protrude through the opening 80 so that the collar 60 can be indexed or rotated to any of its twelve positions. In a selected annular position of collar 60, pivoting of arm 62 to any of its other four angular positions indicated at 97 through 100 will lock the collar 60 in its selected location.

With the arm 62 un-threaded a few turns as indicated by the arrow 101 in FIG. 4 to release the pawl washer 70, the arm can be pivoted from the unlocked position to a first locked position at 97 in which the arm is at a ninety degree (90°) angle to the axis and the input shaft. Movement of the arm 62 to the next position 98 in which the teeth on the pawl washer and the teeth on the brackets 68 are in alignment with each other would be at approximately sixty degrees (60°). Similarly, a third position 99 is at thirty degrees (30°) to the input axis and a fourth position 100 locates the arm 62 parallel to the drive axis. In any of these selected angular positions, the handle or arm 62 can be twisted or rotated in a tightening direction to move the arm 62 against the pawl washer 70 to bring its teeth 74 into tight engagement with the teeth 72 on the brackets 68 to hold the arm both annularly and angularly locked.

The stabilizer collar 60 can be adjusted to twelve circumferential positions in a first plane perpendicular to the input axis of the power head 10 as seen in all of the Figure drawings and the arm 62 can be locked in anyone of four angular positions for every thirty degrees (30°) between a parallel position and a ninety-degree (90°) position relative to the input axis of the power head 10 and in a second plane perpendicular to the first plane. This makes for 48 different locked positions of the stabilizer arm 62, which can be twisted to engage and release the mating rounded teeth 74 of the pawl washer 70 and the teeth 72 on the brackets 68.

One of the multiple stabilizer arm positions is illustrated in FIG. 6 in which the arm is at approximately thirty degrees (30°) as illustrated at position 99 in FIG. 4 and the stabilizer collar 60 has been indexed to position 87*b* in FIG. 5 for positioning the apparatus 10 in the left hand of the operator to absorb torque and leave the right hand free to support and operate the power tool such as a drill motor or powered screw driver.

A stabilizer apparatus for a power head attachment for rotatable power tools has been provided in which a stabilizer arm can be positioned in a selected one of a plurality of positions around the input axis of the attachment and in each one of those positions can be moved to one of four angular locked positions all by simply twisting the arm to permit unlocking followed by selected movement of the arm to the desired position and subsequently twisting the arm to return it to a locked position.

The invention claimed is:

1. A stabilizer apparatus for a power head attachment for rotationally powered hand held tools comprising:

a housing supporting a rotatable input shaft for detachable attachment to a powered tool and a rotatable output shaft rotatably connected together at an angle to each other, an annular stabilizer collar supported on the exterior of said housing and rotatable to selected positions annularly relative to a first plane perpendicular to the axis of said input shaft;

detent means acting between said stabilizer collar and said housing to permit rotation of said stabilizer collar to a selected one of said indexed positions in an unlocked condition of said stabilizer arm;

a stabilizer arm pivotally supported on said collar and pivotally moveable to selected multiple angular positions in a second plane perpendicular to said first plane; and lock means to simultaneously lock said arm in selected angular positions relative to said input shaft and said annular stabilizer collar in selected one of its multiple annular positions relative to said housing.

2. A housing supporting an input shaft and an output shaft connected together at an angle to each other, said input shaft being adapted for detachable attachment to a power tool and said output shaft being adapted for detachable attachment to a working tool;

a stabilizer assembly including an annular collar supported on the exterior of said housing for movement to selected positions in a first plane annularly relative to the axis of said input shaft;

a stabilizer arm pivotally supported on said collar for movement in a second plane perpendicular to said first plane;

detent means including a detent element supported in a cavity formed by an exterior portion of said housing and within said stabilizer collar and wherein the detent element is engageable with a plurality of detent recesses formed by the interior of said stabilizer collar; and lock means associated with said stabilizer arm to simultaneously lock said stabilizer arm in a selected one of said positions relative to said input shaft in said first plane and to lock said annular stabilizer collar in a selected one of its selected positions in a second plane relative to said first plane.

3. A stabilizer apparatus for a power head attachment for rotationally powered hand held tools comprising:

a housing supporting a rotatable input shaft for detachable attachment to a powered tool and a rotatable output shaft rotatably connected together at an angle to each other;

an annular stabilizer collar supported on the exterior of said housing and rotatable to selected positions annularly relative to a first plane perpendicular to the axis of said input shaft;

a stabilizer arm pivotally supported on said collar and pivotally movable to selected multiple angular positions in a second plane perpendicular to said first plane;

detent means acting between said stabilizer collar and said housing permits rotation of said collar to a selected one of said predetermined positions in an unlocked condition of said stabilizer arm and wherein said detent means include a detent element supported in a cavity formed by an exterior portion of housing, and within said stabilizer collar, said detent element being engageable with detent recesses formed by the interior of said stabilizer collar, said detent recesses being in alignment with corresponding lock recesses formed on the exterior of said housing; and lock means to simultaneously lock said arm in selected angular positions relative to said input shaft and said annular stabilizer collar in selected one of its multiple annular positions relative to said housing.

4. An accessory for a power tool comprising:

a housing supporting an input shaft and an output shaft connected together at an angle to each other, said input shaft being adapted for detachable attachment to a power tool and said output shaft being adapted for detachable attachment to a working tool;

a stabilizer assembly including an annular collar supported on the exterior of said housing for movement to selected positions in a first plane annularly relative to the axis of said input shaft;

a stabilizer arm pivotally supported on said collar for movement in a second plane perpendicular to said first plane;

lock means associated with said stabilizer arm to simultaneously lock said stabilizer arm in a selected one of said positions relative to said input shaft in said first plane and to lock said annular stabilizer collar in a selected one of its selected positions in a second plane relative to said first plane, said stabilizer arm being rotatable for threaded movement to move said arm axially into a locked position of said arm.

5. The stabilizer apparatus of claim 4 wherein said stabilizer arm is pivoted about an axis extending between a pair of spaced toothed brackets and wherein a lock element is moveably supported between said threadable arm and said toothed brackets and has teeth complementary to said toothed brackets for engagement with each other in said selected locked position of said arm.

6. The stabilizer apparatus of claim 5 wherein said teeth on said lock element and toothed brackets are rounded to facilitate easy engagement with each other upon movement of said lock element toward said toothed brackets in the locking position of said arm.

7. An accessory for a power tool comprising:

a housing supporting an input shaft and an output shaft connected together at an angle to each other;

said input and output shafts are connected together with miter gears at a 90 degree angle to each other;

said input shaft being adapted for detachable attachment to a power tool and said output shaft being adapted for detachable attachment to a working tool;

a stabilizer assembly including an annular collar supported on the exterior of said housing for movement to selected positions in a first plane annularly relative to the axis of said input shaft;

a stabilizer arm pivotally supported on said collar for movement in a second plane perpendicular to said first plane;

lock means associated with said stabilizer arm to simultaneously lock said stabilizer arm in a selected one of said positions relative to said input shaft in said first plane and to lock said annular stabilizer collar in a selected one of its selected positions in a second plane relative to said first plane.

8. An accessory for a power tool comprising:

a housing supporting an input shaft and an output shaft connected together at an angle to each other, said input shaft being adapted for detachable attachment to a power tool and said output shaft being adapted for detachable attachment to a working tool;

a stabilizer assembly including an annular collar supported on the exterior of said housing for movement to selected positions in a first plane annularly relative to the axis of said input shaft;

detent means operative to index said stabilizer annular collar at said selected predetermined positions, said detent means comprise a spring element mounted in a fixed position on the exterior of said housing and within said annular collar, said spring element being engageable with indexing recesses formed on the interior of said stabilizer collar in uniformly spaced relationship to each other, a stabilizer arm pivotally supported on said collar for movement in a second plane perpendicular to said first plane;

lock means associated with said stabilizer arm to simultaneously lock said stabilizer arm in a selected one of said positions relative to said input shaft in said first plane and to lock said annular stabilizer collar in a selected one of its selected positions in a second plane relative to said first plane.

9. An accessory for a power tool set forth in claim 8 and further comprising a lock portion at one end of said stabilizer arm selectively engageable with lock recesses formed on the exterior of said housing, said indexing recesses on said collar being in alignment with said lock recesses to receive said stabilizer arm in a selected one of said locked positions.

10. An accessory for a power tool set forth in claim 9 wherein said selected predetermined positions of said annular collar relative to said input shaft are uniformly spaced apart.

11. An accessory for power tools set forth in claim 10 wherein said uniformly spaced positions are spaced 30 degrees apart.

12. An accessory for a power tool according to claim 9 wherein said selected position of said stabilizer arm relative to the axis of said input shaft are uniformly spaced apart.

13. An accessory for a power tool according to claim 12 wherein said uniform spaced apart distances are 30 degrees.

* * * * *

UNITED STATES PATENT AND TRADEMARK OFFICE

CERTIFICATE OF CORRECTION

PATENT NO. : 7,191,494 B2
APPLICATION NO. : 10/914926
DATED : March 20, 2007
INVENTOR(S) : John A. Badiali It is certified that error appears in the above-identified patent and that said Letters Patent is hereby corrected as shown below:

Column 2, line 29, replace “by way an input” with -- by way of an input --

Column 4, line 25, replace “it’s” with -- its --

Signed and Sealed this

Seventh Day of August, 2007

JON W. DUDAS
*Director of the United States Patent and Trademark Office*